US005119729A

United States Patent [19]

Nguyen

[11] Patent Number: 5,119,729

[45] Date of Patent: Jun. 9, 1992

[54] PROCESS FOR PRODUCING A HOLLOW CHARGE WITH A METALLIC LINING

[75] Inventor: Cu Hai Nguyen, Uetendorf, Switzerland

[73] Assignee: Schweizerische Eidgenossenschaft Vertreten Durch die Eidg. Munitionsfabrik Thun der Gruppe für Rüstungsdienste, Thun, Switzerland

[21] Appl. No.: 433,589

[22] Filed: Nov. 8, 1989

[30] Foreign Application Priority Data

Nov. 17, 1988 [CH] Switzerland ..... 4264/88

[51] Int. Cl.[5] ..... F42B 1/02

[52] U.S. Cl. ..... 102/307; 102/310; 102/476

[58] Field of Search ..... 102/307, 309, 310, 476

[56] References Cited

U.S. PATENT DOCUMENTS 4,551,287 11/1985 Bethmann ..... 264/3.1
4,860,654 8/1989 Chawla et al. ..... 102/307 X
4,860,655 8/1989 Chawla et al. ..... 102/309 X
4,867,061 9/1989 Stadler et al. ..... 102/307
4,949,642 8/1990 Wisotzki ..... 102/307

*Primary Examiner*—Peter A. Nelson
*Attorney, Agent, or Firm*—Schweitzer Cornman & Gross

[57] ABSTRACT

A hollow charge for piercing armor built up of several layers of differing densities, the metallic lining of which has three-dimensional isotropy and the density of which corresponds at least approximately to the crystal density of the metal, and, upon detonation, produces an incoherent, pulverulent hollow-charge jet. The associated method of manufacturing the metallic lining comprises atomization of the metal; the mixing of the resulting metal powder in a broad particle-size distribution; the filling of the metal powder into a uniform thickness, double-walled, ductile container; hydrogen flushing of the filled-in metal powder, the closure and gas-tight sealing-off of the double-walled container; hot isostatic pressing of the container; and the removal of the sealed-off container from the pressure-molded component.

11 Claims, 2 Drawing Sheets

PROCESS FOR PRODUCING A HOLLOW CHARGE WITH A METALLIC LINING

METHOD AND DEVICE FOR ITS MANUFACTURING

The present invention relates to a hollow charge for the piercing of armor plating typically consisting of layers which would deflect a homogeneous hollow-charge jet, and comprises an ammunition body with a rotationally symmetrical, ductile, metallic lining rigidly embedded in the explosive, a method for manufacturing this lining and a device for carrying out this manufacturing method.

BACKGROUND OF THE INVENTION

Hollow charges have long been used against armor, leading to the development of the most varied countermeasures such as, in particular, the utilization of armor plate having layers of materials of widely differing densities and hardnesses, causing a homogeneous hollow-charge jet to be deflected.

Subsequently, hollow charges were developed that had a lining composed of a pseudo-alloy of tungsten and copper, such as that disclosed in French Patent FR-A-2 530 800. This lining is prepared powder-metallurgically by sintering tungsten powder with a particle size smaller than 50 μm, with copper powder, the tungsten component amounting to 80% by weight. Due to the sintering process, such linings are of relatively low density and, particularly against layered armor, have only a slight piercing capability although their deflection is less than prior charges.

It is an object of the present invention to provide a hollow charge having a high piercing effect with respect to armor plating which would deflect and/or disturb conventional hollow-charge jets.

It is equally an object of the invention to provide a method for manufacturing and a device for carrying out the method which permits the economical and efficient manufacture of the metallic lining of the hollow charge of the invention.

SUMMARY OF THE INVENTION

The above and other objects of the invention are achieved by providing a metallic hollow-charge lining having three-dimensional isotropy, the density of which lining corresponds at least approximately to the crystal density of the metal.

The method of manufacture for the metallic lining is characterized by the following features:

at least one metal is atomized in a stream of air or an inert gas;

the resulting metal powder is mixed in a broad particle-size distribution;

the metal powder thus prepared is directed into the interspace of a rotationally symmetrical, double-walled, ductile, high-temperature-resistant container mold of at least approximately uniform wall thickness;

the interspace and metal powder contents are flushed and/or reduced with hydrogen;

the double-walled container is closed and sealed off in a gas-tight manner;

the sealed-off container is exposed on all sides to an elevated gas pressure while being heated at the same time, resulting in hot isostatic pressing; and the sealed-off container is removed from the pressure-molded component.

The device for carrying out the manufacturing method is characterized in that the double-walled container mold is made of structural steel, a light metal or a quartz glass, and has a wall thickness of 0.8 to 3.0 mm.

Due to its three-dimensional isotropy, the lining of the hollow charge of the invention has a texture-free, crystalline structure which achieves more than 98% of the maximum possible crystal density.

The hollow charge according to the invention has an enormous advantage as, after detonation, the hollow-charge jet resulting penetrates armor plating in a pulverized, i.e., non-coherent state and is thus not deflected by layered armor plating. Density of the jet is high; moreover, it is possible to use materials for the charge that are non-alloyable or not suitable for sintering processes used in conventional charge manufacture.

The method according to the invention for manufacturing the metallic lining of hollow charges has furthermore the great advantage that it achieves greater precision as to shape and dimensions with substantially less expenditure in material than is possible with conventional methods. Manufacturing by the method according to the invention is thereby also more economical and less labor-intensive.

The resulting stripped lining is very precise with respect to shape and dimensions ("near net shaping") and therefore needs only slight secondary operation, such as by machining, to allow mounting in the ammunition body.

The method of the present invention has been utilized with copper, tantalum, tungsten and uranium linings. It is also applicable to mixtures of the above-mentioned metal powders. The method parameters are then determined primarily by the metal comprising the largest proportion of the metal powder.

DESCRIPTION OF THE FIGURES

Further advantages of the present invention will become apparent in the subsequent description in which the invention is explained in greater detail with the aid of drawings representing embodiments given by way of examples, wherein.

DESCRIPTION OF PREFERRED EMBODIMENTS

Figure 1A:
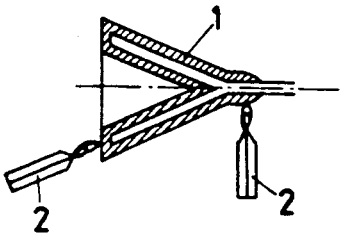
FIGS. 1A–F are schematic representations of the method steps for the manufacturing of a rotationally symmetrical, ductile metallic lining.
Figure 1B:
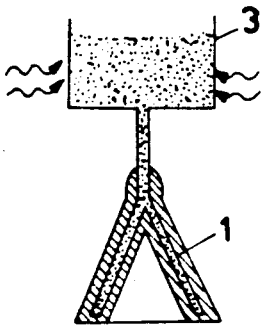
Figure 1C:
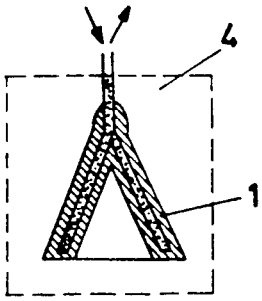
Figure 1D:
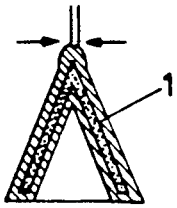
Figure 1E:
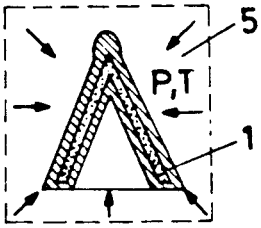
Figure 1G:
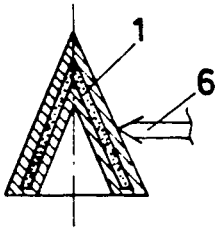

In FIG. 1, the separate steps of the manufacturing method for a rotationally symmetrical, metallic lining are represented schematically and marked with capital letters as follows:

In step A a double-walled container 1 is produced by a conventional sheet-metal processing, such as bending and the use of welding devices 2. Further details of the double-walled container 1 are explained in the subsequent description of FIGS. 2 and 3.

In step B a metal powder, for instance copper, having a flat, broad particle-sized distribution between 10 and 200 μm is poured from a filling container 3 into the double-walled container 1, while the filling container 3 is being vibrated (indicated by arrows) to achieve as high a filling density as possible. Vibration also helps create a homogenous fill, without gas or air inclusions. Depending on the composition of the individual consignments of metal powders utilized, it may be necessary to form a mixture of several powder consignments to obtain the desired particle size distribution. In some cases, it may be necessary to sieve the powder prior to use, as a particle size of 200 μm must not be exceeded.

The metal powders utilized may be produced by atomizing in an air or inert-gas stream as known in the art. Such methodology, however, facilitates the oxidation of the surfaces of the powder grains and allows air or inert-gas inclusions to be formed in the powder. With oxidizable metals, reduction or powder purification is therefore required to insure reliable functioning of the resulting charge and to remove such oxides and gas inclusions.

Accordingly, metal powder in the filled, double-walled container 1 is purified, i.e., reduced, by flushing with hydrogen (indicated by arrows) for one hour at 400 degrees C, as depicted at C. This eliminates the oxides and any gas inclusions present.

Immediately after flushing, the double-walled container 1 is hermetically sealed in step D as shown by the counter-directed arrows, which prevents subsequent oxidation or other contamination of the metal powder. To this end, the filling tube of the double-walled container may be crimped, cut, and sealed by welding.

In step E the closed double-walled container 1 is subjected to treatment by the hot isostatic pressing method (HIP) in autoclave 5, details of which can be found in an article by P. E. Price and S. P. Kohler, "Hot Isostatic Pressing of Metal Powders", *Metals Handbook, Powder Metallurgy*, 9th ed., Vol. 7 (6/1984), p. 419 ff; Metals Park ASM. The autoclave 5 may be the graphite furnace type of the firm J. Dieffenbacher GmbH Co., with a pressure resistance of 350 MPa and a temperature resistance of 3000 degrees C.

Figure 1F:
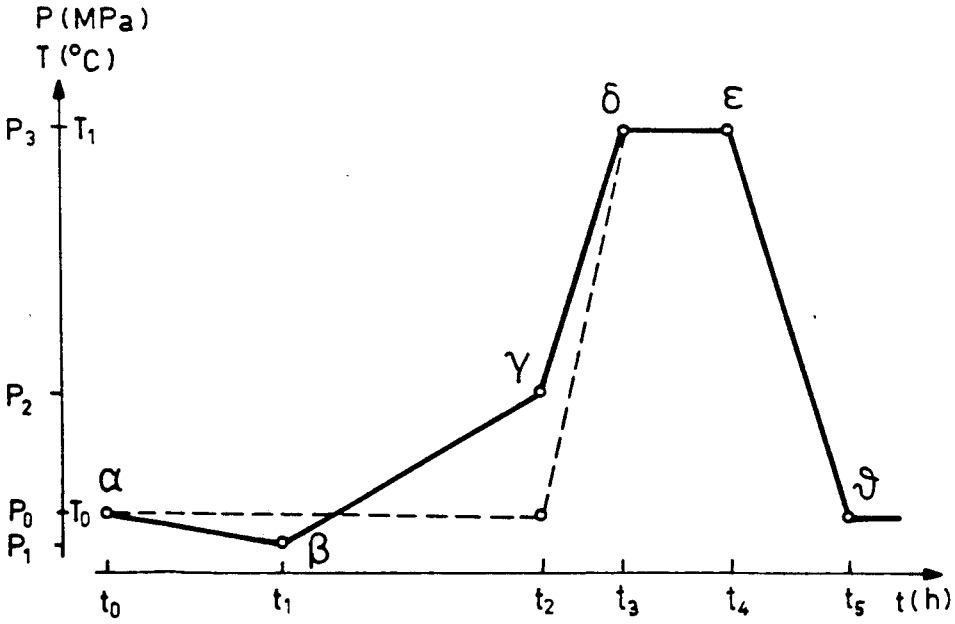

FIG. 1F shows the pressure and temperature during the separate stages of the hot isostatic pressing as a function of time, the pressure curve (P,t) being denoted by solid lines and the temperature curve (T,t) by broken lines. Starting at point $\alpha$ at normal pressure ($P_0$) and normal temperature ($T_0$), evacuation of the autoclave 5 is initiated (time $t_0$), up to point $\beta$(time $t_1$), when a depression $P_1$ of 10 Pa is attained. The autoclave 5 is then filled with argon to a pressure $P_2$ of 30 MPa (point $\gamma$ ; time $t_2$). Starting from this point, the temperature is raised from $T_0$ (ambient temperature $\approx$20 degrees C) to a temperature $T_1$ to be determined according to the metal selected (point $\delta$ ; time $t_3$). The HIP temperature $T_1$ normally lies between the recrystallization temperature, which is approximately half the melting temperature, and the melting temperature of the metal. For copper, $T_1$ lies between 650 degrees C. and 1050 degrees C., and is preferably 800 degrees C. For tantalum, $T_1$ lies between 1700 degrees C. and 2980 degrees C., and is preferably 2200 degrees C., for tungsten $T_1$ lies between 1000 degrees C. and 1800 degrees C., and is preferably 1430 degrees C.; and for uranium it is between 600 degrees C. and 1120 degrees C., preferably at 850 degrees C. Too low a HIP temperature causes an undesirable porosity of the workpiece; too high a HIP temperature produces an undesirable growth of crystallites.

At the temperature rise, pressure in the autoclave 5 increases due to the expansion of the gas (law of Boyle-Gay-Lussac) to a pressure $P_3$ which should be at least 100 MPa and at most 320 MPa. A preferred pressure $P_3$ is 130 MPa. To keep manufacturing costs possible may be simultaneously hot-isostatically pressed in the autoclave 5.

During a certain time interval ($t_4$–$t_5$), which is between 1 and 6 hours, and preferably about 3 hours, temperature $T_1$ and pressure $P_3$ are maintained constant (line $\delta$-$\epsilon$), after which the temperature is permitted to drop to the ambient temperature $T_0$ and pressure is reduced to normal pressure $P_0$ (point $\theta$). Cooling of the workpieces embedded in the containers 1 should proceed slowly, to prevent allotropic transformations, and especially martensitic transformation in the welding seams. These are liable to lead to hardening and embrittlement which would make the subsequent turning operations more difficult and would impair the isotropy of the lining produced.

After the hot isostatic pressing, the double-walled container 1, as well as the oversize of the workpiece, are removed in two turning operations of step G. The first is a rough cut, for which the container may be pneumatically chucked about its interior wall on a lathe. The exterior wall is then rough-machined, using a lathe tool 6, until the exterior container wall is fully removed. The rough-machined exterior wall is then chucked, and the interior wall rough-machined, until it, too, is removed. The second turning operation is a finishing operation, causing the workpiece surfaces to become smooth. This operation must be performed with great care so as not to produce structural changes in the hot isostatically pressed metal. It is, however, possible to utilize other removal methods, such as by the aid of a laser cutting device.

The resulting lining for a hollow charge produced in this way has a texture-free, crystalline structure and is practically isotropic, having the same physical properties throughout, in any direction.

Figure 2:
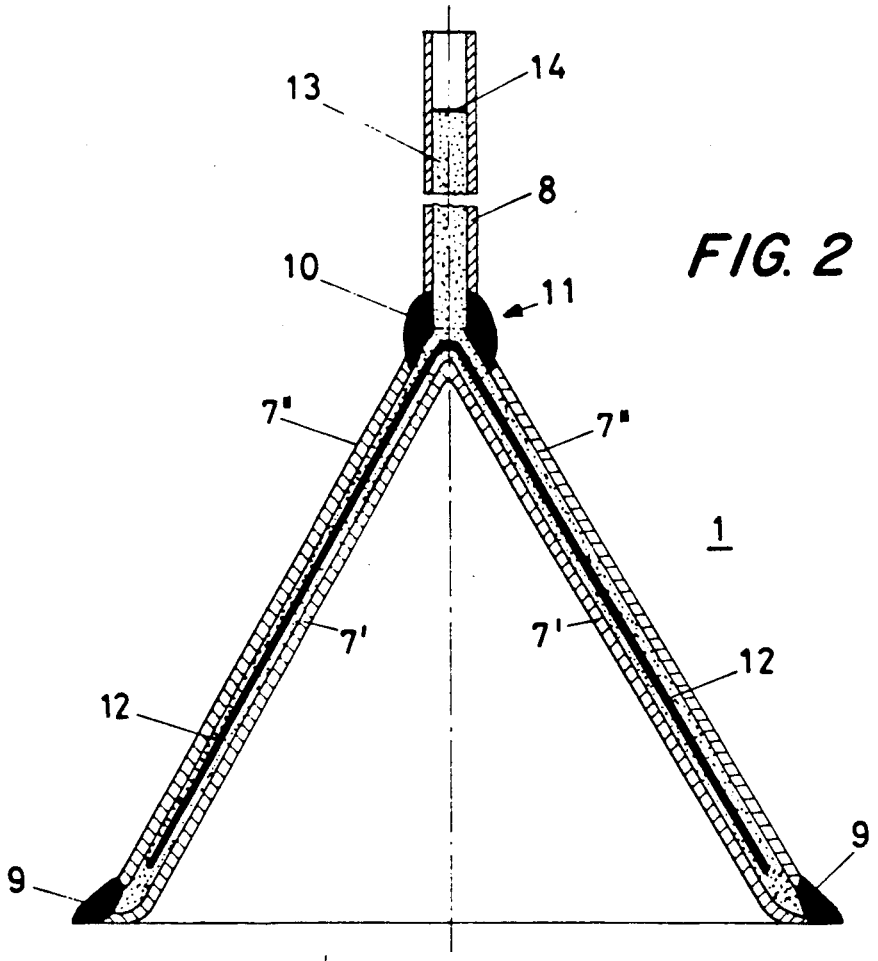
FIG. 2 shows a double-walled, conical container utilized in the present invention having a filling socket arranged at its top.

FIG. 2 is a more detailed representation of the double-walled container 1. As shown therein, the container 1 consists of a metallic internal cone wall 7', a metallic external cone wall 7'', and a filler tube or socket 8. The lower edge of the internal cone wall 7' is flanged outwardly and, by means of a lower welding seam 9, is joined to the exterior cone wall 7''. The filler socket 8 is mounted to an opening 10 at the apex of the exterior cone wall 7'' and is welded thereto via an upper welding seam 11.

The container 1 is made either of a light-metal alloy comprising Al and Mn, Al and Mg, or Al, Mg and Si for a HIP-temperature range of up to 600 degrees C.; of commercially available structural steel, i.e. a steel containing less than 2% carbon, for a HIP-temperature range from 600 degrees C. to 1500 degrees C.; or of a high-melting-point quartz glass for a HIP-temperature range from 1500 degrees C. to 3000 degrees C. The cone walls 7' and 7'', and filler socket 8 may be of identical thickness, which may be between 0.8 mm and 3.0 mm. The wall thickness is selected so that, on the one hand, it is great enough to absorb the high pressure of hot isostatic pressing and, on the other, thin enough to bear the compression of the metal powder without cracking or warping. To achieve a maximally homogenous (isostatic) pressure distribution, the interspace 12 between the cone walls 7' and 7'' should be made as small as possible. The width of the interspace 12 also depends on the material of the double-walled container 1, on the metal powder 13 to be compressed and on the compaction of the powder in the as-poured state. For structural steel and copper powder, for example, this width is preferably 2.0 mm, and for quartz glass and tungsten powder, 3.0 mm, corresponding to a wall thickness of the hot-isostatically pressed workpiece of 1.2 mm.

During the hot isostatic pressing process, the cone walls 7', 7'' will be most strongly deformed in the middle region, as the end regions are fixed by the welding seams 9 and 11, the width of the interspace 12 being therefore hardly reduced at these zones. A geometry-dependent safety margin should be provided which will compensate for the deformation of the cone walls 7' and 7'' occurring during the hot isostatic pressing. Furthermore, the apex angle of the double-walled container 1 will slightly increase, i.e., by about 1 degree. This deformation can be allowed for by an additional widening of the interspace 12 or, preferably, by a reduction of the apex angle.

The filling level 14 of the metal powder 13 to be filled in is determined empirically with consideration that the metal powder 13 must not be blown out of the double-walled container proper during hydrogen flushing, and sufficient compressed metal powder should be present at the extremities (welding seam 9 and 11) to prevent the workpiece from becoming porous at these points after hot isostatic pressing.

Figure 3:
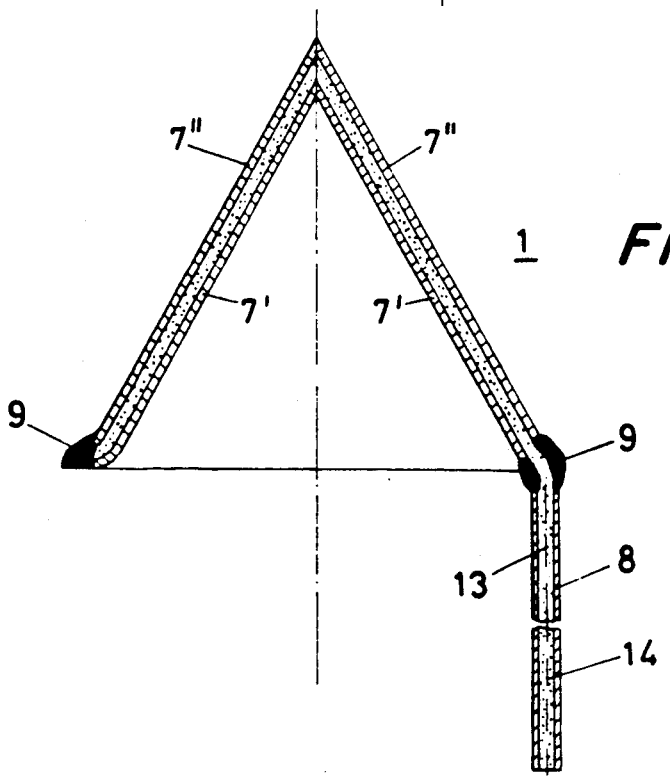
FIG. 3 illustrates a double-walled, conical container with the filling socket arranged below.

FIG. 3 shows a double-walled container 1 with a filler socket 8 at the lower end. This has been found advantageous for trouble-free pouring, resulting in better compaction at the extremities of the container 1, such as at the cone apex. During pouring, the container 1 is vibrated, e.g., by ultrasound, so that a high degree of compaction of the metal powder 13 is achieved in the entire container 1.

In the above-described manufacturing method it is particularly important that, during hot isostatic pressing, the rotationally symmetrical container 1 as such should be crushed as little as possible. This requirement can be met by a container closed on one side as in the above conical shape, or with a onesidedly closed cylindrical shape.

The thus manufactured conical linings are lockedly embedded in an ammunition body and, together with the latter, form a hollow charge, the hollow-charge jet of which is non-homogeneous. Such hollow charges are particularly suitable for piercing armor plating built up of layers having differing physical properties and behavior.

What is claimed is:

1. A method for manufacturing a metallic lining characterized by the steps of atomizing at least one metal in a stream of a gas chosen from the group consisting of air and the inert gases;

mixing the resulting metal powder to from a broad particle-size distribution;

filling the interspace of a rotationally symmetrical, double-walled ductile, high-temperature resistant container of at least approximately uniform wall thickness with said metal powder;

flushing said interspace and said powder therein with hydrogen;

sealing the double-walled container in a gas-tight manner;

heating and exposing the sealed off container to an elevated gas pressure to result in hot isostatic pressing of the contents to form a pressure-molded component; and removing the container from the pressure-molded component.

2. The method for manufacturing a metallic lining as claimed in claim 1 characterized in that the double-walled container is exposed to a gas pressure of at least 100 MPa and brought to a temperature lying between the recrystallization temperature and the melting temperature of the metal to be processed.

3. The method for manufacturing a metallic lining as claimed in claim 2, wherein said metal is copper and the double-walled container is exposed to a gas pressure of between 100 MPa and 320 MPa, and is heated to a temperature of between 550 degrees C. and 1050 degrees C., for a period of time of 1 hour to 6 hours.

4. The method of claim 3, wherein said gas pressure is 130 MPa, said temperature is 800 degrees C., and said time is 3 hours.

5. The method for manufacturing a metallic lining as claimed in claim 2, wherein said metal is tantalum, and the double-walled container is exposed to a gas pressure of between 100 MPa and 320 MPa, and is heated to a temperature of between 1700 degrees C. and 2980 degrees C., for a period of time of 1 hour to 6 hours.

6. The method of claim 5, wherein said pressure is 130 MPa said temperature is 2200 degrees C., and said time is 3 hours.

7. The method for manufacturing a metallic lining according to claim 2, wherein said metal is tungsten, and the double-walled container is exposed to a gas pressure of between 100 MPa and 320 MPa, and is heated to a temperature of between 1000 degrees C. and 1800 degrees C., for a period of time of 1 hour to 6 hours.

8. The method of claim 7, wherein said pressure is 130 MPa, said temperature is 1430 degrees C., and said time is 3 hours.

9. The method for manufacturing a metallic lining as claimed in claim 2, wherein said metal is uranium, and the double-walled container is exposed to a gas pressure of between 100 MPa and 320 MPa, and is heated to a temperature of between 600 degrees C. and 1120 degrees C., for a period of time of 1 hour to 6 hours.

10. The method of claim 9, wherein said pressure is 130 MPa, said temperature is 850 degrees C., and said time is 3 hours.

11. A device for carrying out the manufacturing method as claimed in any one of claims 11 to 10, characterized in that the material of said double-walled container is chosen from the group consisting of structural steel, light metal and quartz glass, said container having a wall thickness of 0.8 to 3.0 mm.

* * * * *